US006142324A

United States Patent [19]

Huang

[11] Patent Number: 6,142,324

[45] Date of Patent: Nov. 7, 2000

[54] ASSEMBLY BRACKET

[76] Inventor: Lian-Chuen Huang, 12F-4, No. 902, Dong Guang Rd., Taichung City, Taiwan

[21] Appl. No.: 09/328,379

[22] Filed: Jun. 9, 1999

[51] Int. Cl.[7] ..... A47B 47/00

[52] U.S. Cl. ..... 211/188; 211/194; 312/265.1; 312/265.2

[58] Field of Search ..... 248/188.1, 127, 248/158, 163.1, 146; 312/265.1, 265.4, 224, 265.2, 265.3; 220/688, 685, 668, 662; 108/16; 211/188, 194, 182, 186

[56] References Cited

U.S. PATENT DOCUMENTS

| | | | |
|---|---|---|---|
| 1,208,628 | 12/1916 | Nutrizio | 248/127 |
| 2,036,113 | 3/1936 | Befera | 248/163.1 |
| 2,200,690 | 5/1940 | Elliott | 248/127 |
| 2,550,793 | 5/1951 | Ferriera | 248/163.1 |
| 3,462,021 | 8/1969 | Hawke et al. | 211/182 |
| 3,498,654 | 3/1970 | Diaz et al. | 248/188.1 |
| 3,655,065 | 4/1972 | Yellin | 211/194 |
| 3,772,572 | 11/1973 | Marquette | 211/162 |
| 3,964,810 | 6/1976 | Murphy | 312/265.2 |
| 4,117,783 | 10/1978 | Ecket et al. | 108/91 |
| 4,187,649 | 2/1980 | Chaffee | 312/265.1 |
| 4,419,938 | 12/1983 | Kaut | 108/190 |
| 4,718,630 | 1/1988 | Richard | 248/163.1 |
| 5,016,765 | 5/1991 | Leonardo | 211/189 |
| 5,662,298 | 9/1997 | Collins | 248/188.1 |
| 6,019,446 | 2/2000 | Laboch et al. | 312/265.1 |

FOREIGN PATENT DOCUMENTS

| | | | |
|---|---|---|---|
| 785124 | 12/1980 | Russian Federation | 220/668 |

*Primary Examiner*—Ramon O. Ramirez
*Assistant Examiner*—Jon A Szumny
*Attorney, Agent, or Firm*—Dougherty & Troxell

[57] ABSTRACT

The present invention relates to an assembly bracket with a number of individual main frame bodies assembled together, each having two side frames, two lower connecting shafts, two holding shafts and a plate piece all of which are secured to be in a cube-shaped form. The two side frames include at least one curved side frame and the holding shafts can hold a metal, glass, or wooden plate piece. The assembled main frame body has at least one concave or convex side for a different assembly arrangement.

4 Claims, 4 Drawing Sheets

ASSEMBLY BRACKET

BACKGROUND OF THE INVENTION

1. Field of the Invention

The present invention relates to an assembly bracket, and more particularly to an assembly bracket having a number of main frame bodies with arched side frames for different ways of assembly and arrangement.

2. Description of the Prior Art

The conventional assembly bracket is assembled with a number of individual main frame bodies with the same shape. Since each main frame body has the same form, the appearance after assembly is not changed, but only enlarged in shape. Therefore, its appearance gives us a dull image without beauty.

SUMMARY OF THE INVENTION

It is the main object of the present invention to provide an assembly bracket having main frame bodies with at least one curved side frame for a different assembly and arrangement.

BRIEF DESCRIPTION OF THE DRAWINGS

The drawings disclose illustrative embodiments of the present invention which serves to exemplify the various advantages and objects hereof, and are as follows:

FIG. 2A is an enlarged view of area A in FIG. 2;

FIG. 2B is an enlarged view of area B in FIG. 2;

3

FIG. 4A is an enlarged view of area D in FIG. 4;

DETAILED DESCRIPTION OF THE PREFERRED EMBODIMENT

Figure 1:
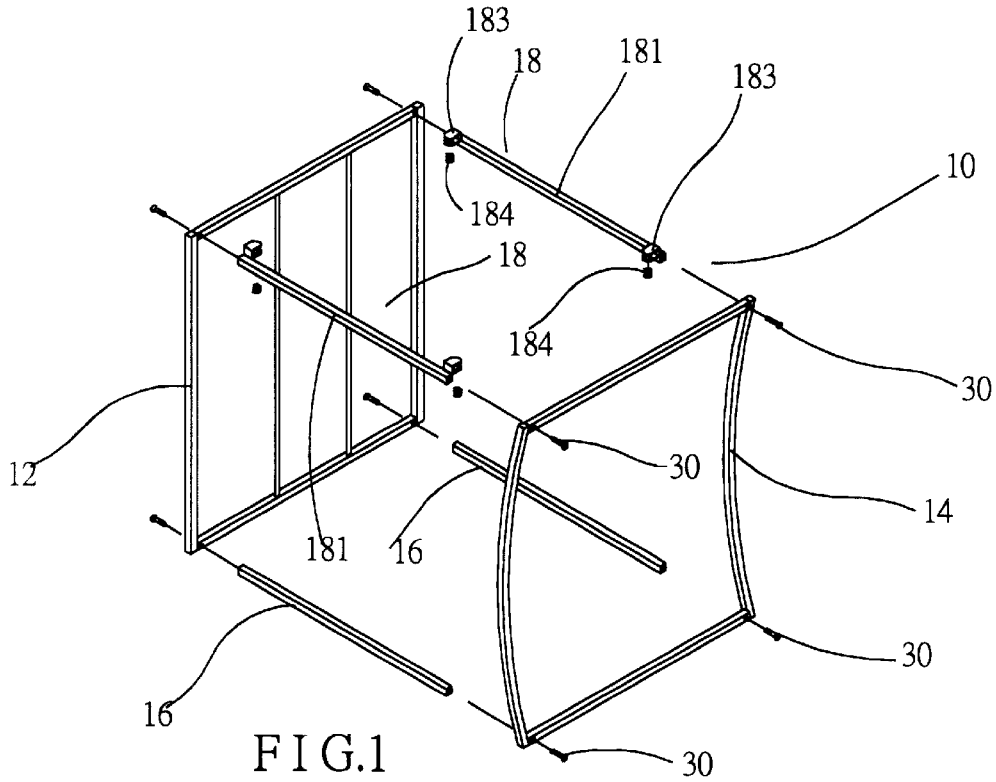
FIG. 1 an exploded perspective view of a preferred embodiment of the present invention.
Figure 2:
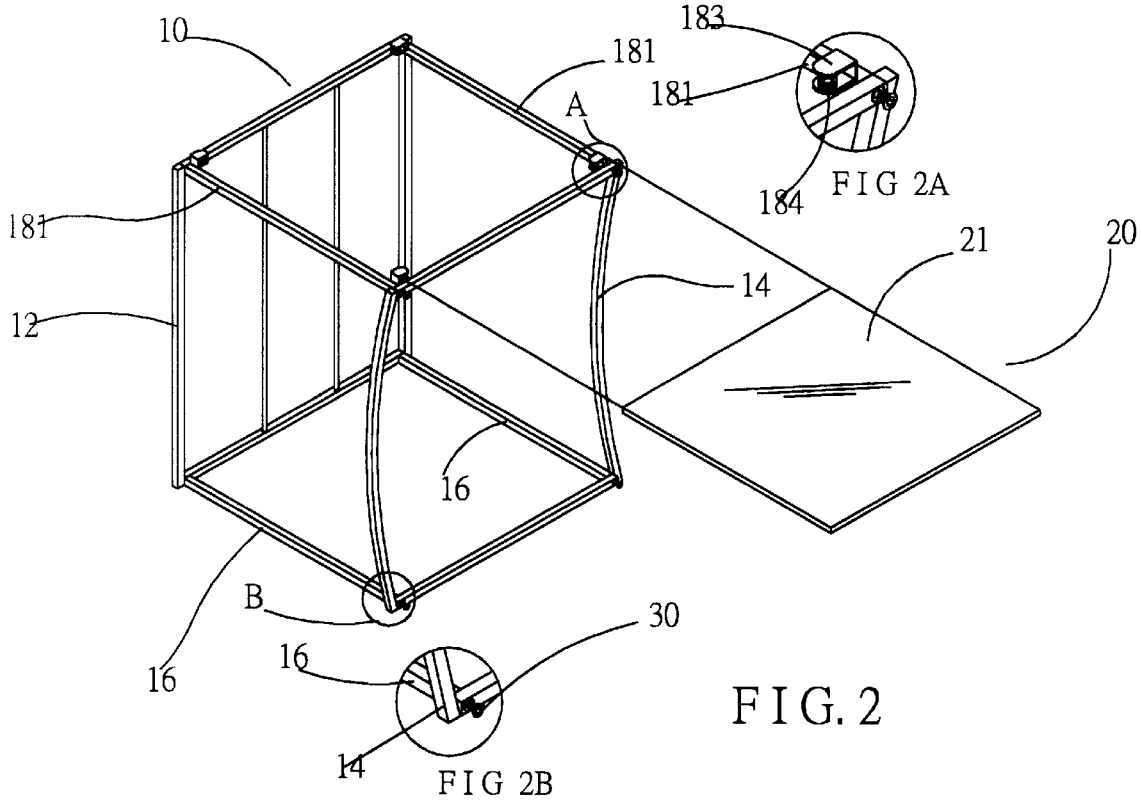
FIG. 2 is an assembly perspective view in accordance with FIG. 1, illustrating how a glass or metal plate is clamped and fixed.
Figures 3, 3A:
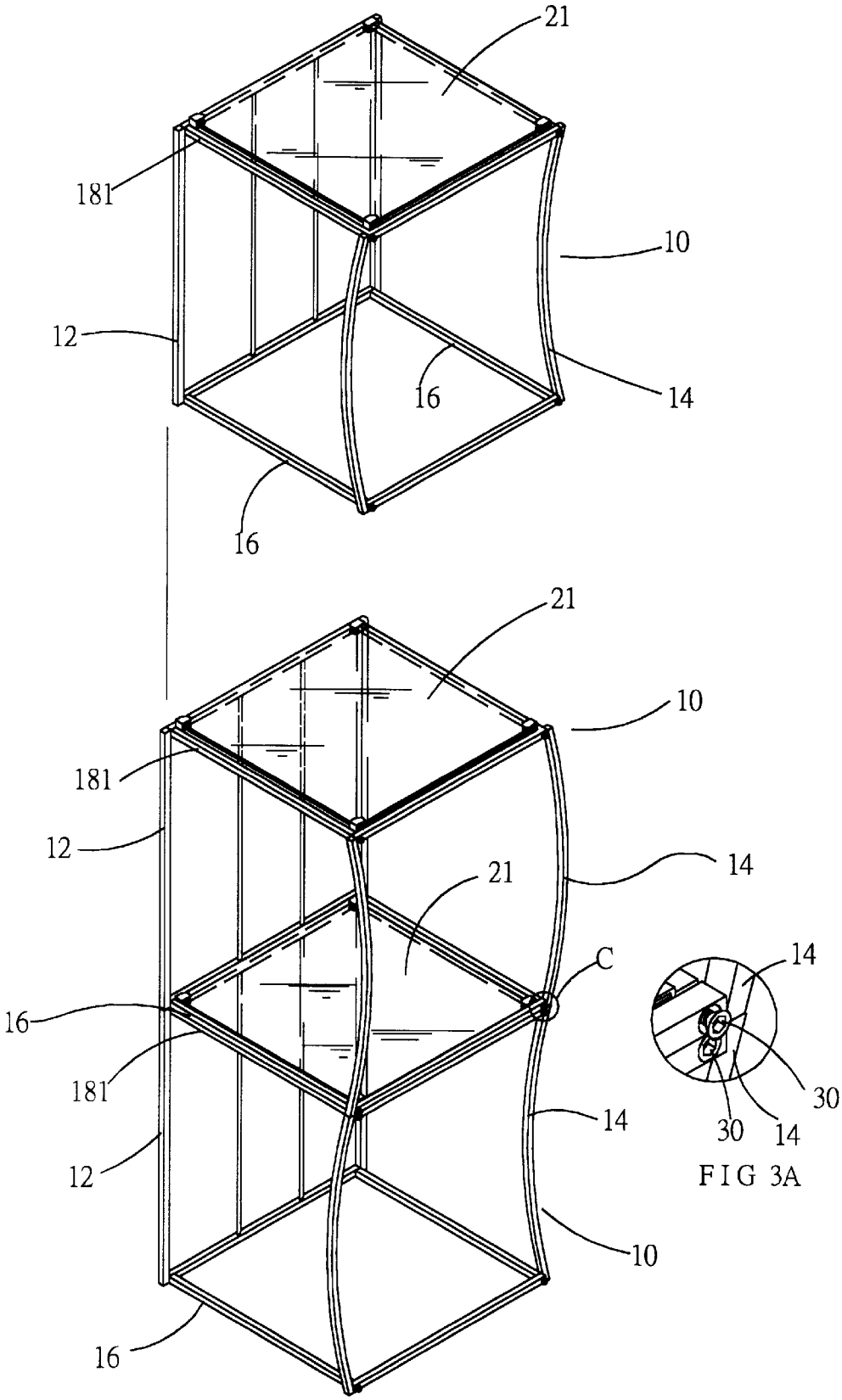
FIG. 3 is an assembly perspective view in accordance with FIG. 1.
FIG. 3A is an enlarged view of area C in FIG. 3.
Figure 4:
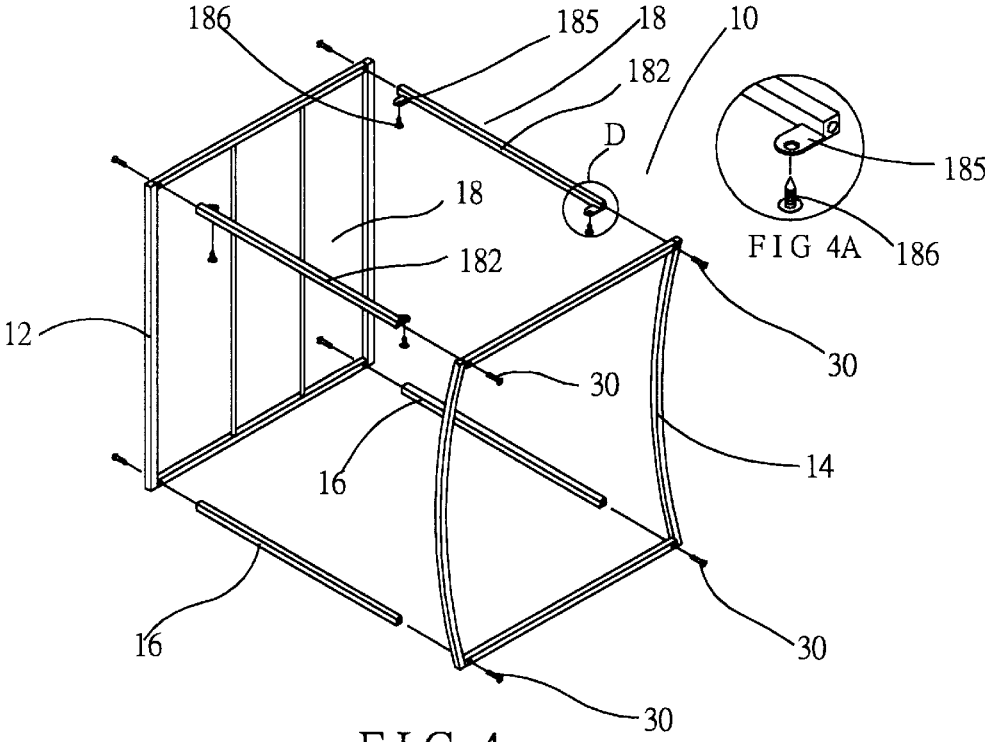
FIG. 4 is an exploded perspective view of another preferred embodiment of the present invention.
Figure 5:
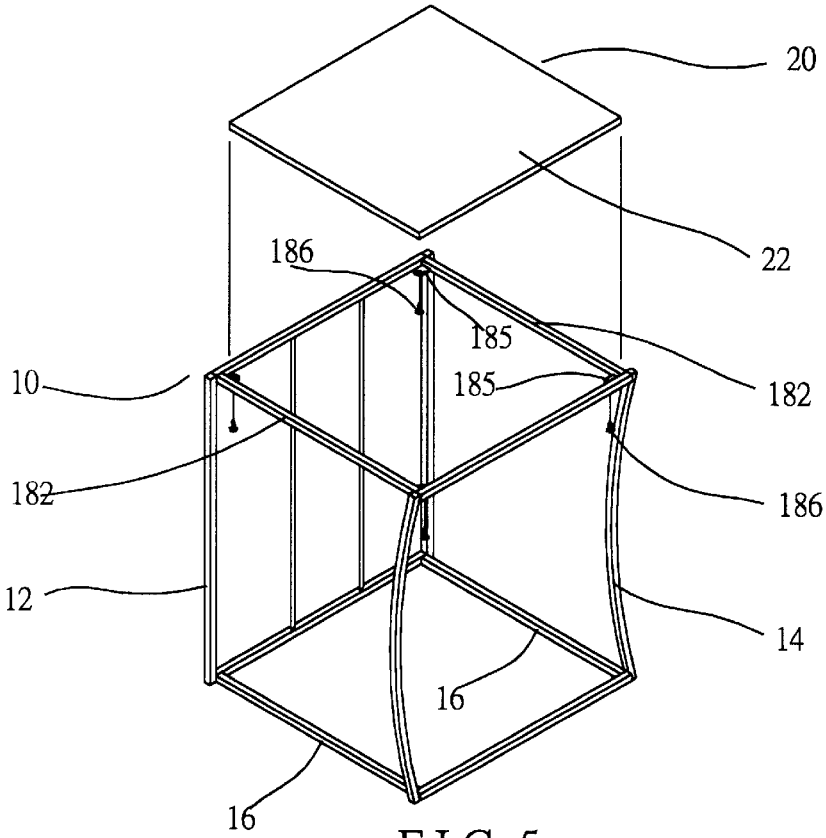
FIG. 5 is an assembly perspective view in accordance with FIG. 4, illustrating how a wooden plate is clamped and fixed.

First of all, referring to FIGS. 1, 2 and 3, they show a preferred embodiment of the present invention which includes a number of individual main frame bodies 10 assembled together. The main frame body 10 consists of two side frames 12, 14, two lower connecting shafts 16, two holding shafts 18 and a plate piece 20 all of which are secured with several screws 30 to be in a cube-shaped form, wherein the two side frames 12, 14 include at least one curved side frame 14.

Thereafter, please refer to FIGS. 1, 2, 4 and 5. The holding shafts 18 can be a holding shaft 181 for holding metal or glass plate piece 21 and a holding shaft 182 for holding wooden plate piece 22. The holding shaft 181 for holding metal or glass plate piece 21 is fitted with two sets of corresponding C-shaped clamping ears 183 at upper sides a duo edges, and they are joined and fixed with soft plastic screws 184 from the bottom to the top. The holding shaft 182 for holding wooden plate piece 22 is fitted with two sets of corresponding supporting pieces 185 at lower sides at two ends on which the wooden plate piece 22 can be placed. Thereafter, screws 186 are tightened into the wooden plate piece 22 from the bottom to the top to achieve a positioning effect.

Figures 6, 6A, 6B:
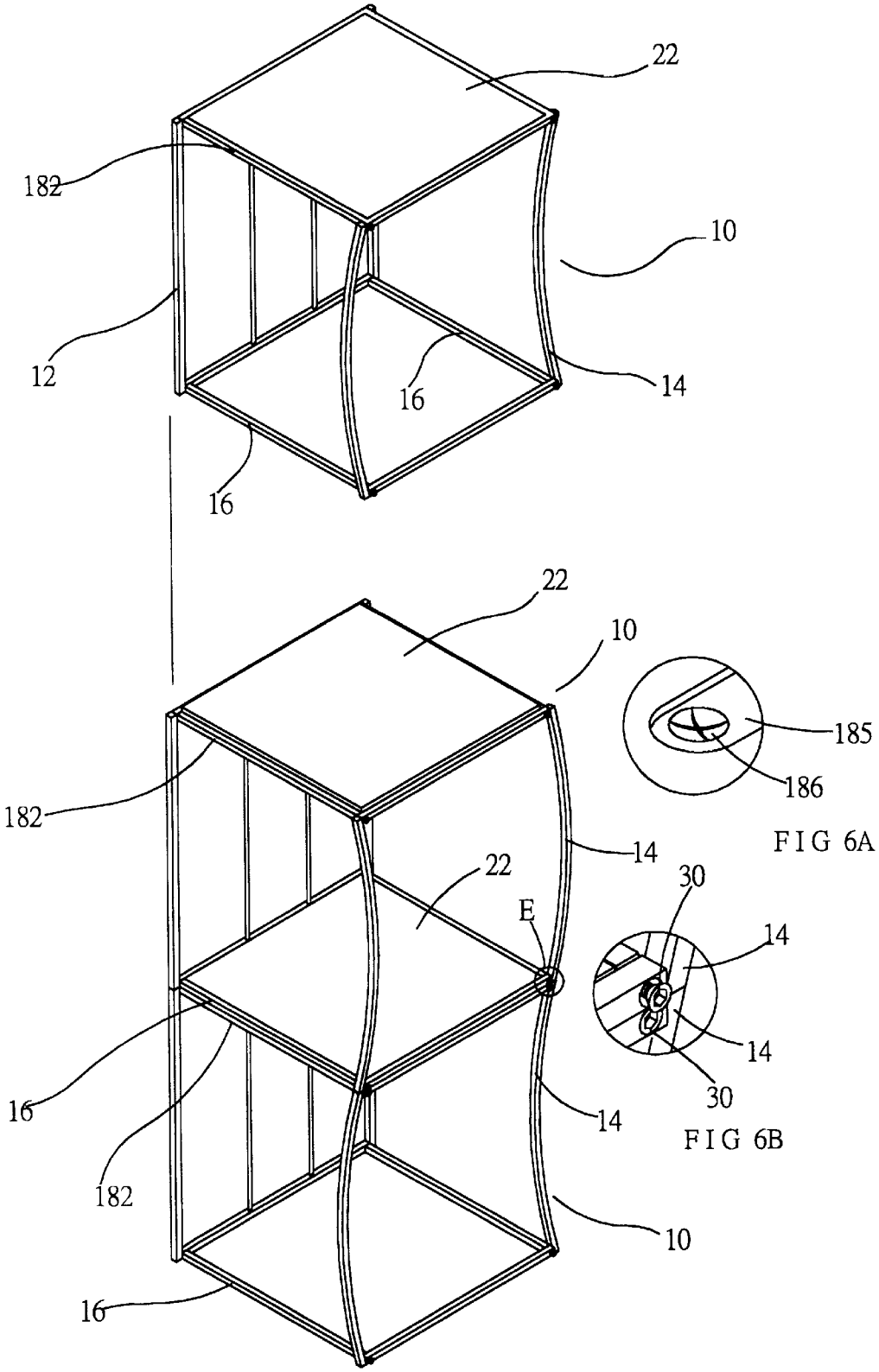
FIG. 6 is an assembly perspective view in accordance with FIG. 4.
FIG. 6A is an enlarged view of the supporting piece of the present invention.
FIG. 6B is an enlarged view of area E in FIG. 6.

The assembly of the above-mentioned members is shown in FIG. 3 and 6. The plate piece 20 at the top is situated higher than the two side frames 12, 14 10 after the assembly of each main frame body 10 is finished. Therefore, in placing another upper main frame body 10, the screws 30 of the lower connecting shafts 16 of the main frame body 10 can be loosened first so as to place the bottom of the upper main frame body around the edge of the plate piece 20. After finishing the connection procedures, the screws 30, are tightened so that the bottom of the upper main frame body 10 is firmly clamped around the plate piece 20 of the lower main frame body 10. Accordingly, the upper main frame body 10 can be prevented from being dropped down or knocked over. Then, the main frame bodies 10 can be assembled up to a certain height.

The curved side frame 14 of each main frame body 10 can be concavely or convexly curved in accordance with the real application in order to achieve the variability of the whole appearance with different curved shapes.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An assembly bracket comprising:

a) at least first and second main frame bodies, each main frame body having:

i) first and second side frames, at least one of the side frames having a curved configuration;

ii) two lower connecting shafts connected to lower portions of the first and second side frames;

iii) two upper holding shafts connected to upper portions of the first and second side frames, each upper holding shaft having an upper side; and, iv) mounting devices located at opposite ends of each of the two upper holding shafts; and b) a plate piece connected to the mounting devices on the upper holding shafts of at least the first of the main frame bodies so as to be located higher than the upper sides of the two upper holding shafts, the plate piece being clamped by the lower connecting shafts and lower portions of the side frames of the second main frame so as to mount the second main frame body on the first main frame body.

2. The assembly bracket of claim 1 wherein the mounting devices comprise C-shaped clamping ears attached to the upper holding shafts.

3. The assembly bracket of claim 1 wherein the plate piece comprises a glass plate piece.

4. The assembly bracket of claim 1 wherein the plate piece comprises a wooden plate piece.

* * * * *